US012805582B2

(12) United States Patent
Hilton

(10) Patent No.: US 12,805,582 B2
(45) Date of Patent: Nov. 24, 2026

(54) SWADDLING GARMENT

(71) Applicant: KNITit LLC, Holland, MI (US)

(72) Inventor: Elizabeth Ann Hilton, Holland, MI (US)

(73) Assignee: KNITit LLC, Holland, MI (US)

( * ) Notice: Subject to any disclaimer, the term of this patent is extended or adjusted under 35 U.S.C. 154(b) by 0 days.

(21) Appl. No.: 19/179,363

(22) Filed: Apr. 15, 2025

(65) Prior Publication Data

US 2026/0157449 A1 Jun. 11, 2026

Related U.S. Application Data

(60) Provisional application No. 63/651,141, filed on May 23, 2024.

(51) Int. Cl.

| | |
|---|---|
| ***A41B 13/06*** | (2006.01) |
| ***A41B 13/00*** | (2006.01) |
| *A41B 13/08* | (2006.01) |

(52) U.S. Cl.

CPC ..... *A41B 13/06* (2013.01); *A41B 13/005* (2013.01); *A41B 2500/10* (2013.01)

(58) Field of Classification Search

CPC .... A41B 13/06; A41B 13/005; A41B 2500/10
See application file for complete search history.

(56) References Cited

U.S. PATENT DOCUMENTS

| | | | | |
|---|---|---|---|---|
| 5,129,406 | A * | 7/1992 | Magnusen | A41B 13/06 128/845 |
| 6,151,927 | A * | 11/2000 | Owens | D04B 1/18 66/178 R |
| 6,393,612 | B1 * | 5/2002 | Thach | A41B 13/065 2/69.5 |
| 6,868,566 | B2 | 3/2005 | Gatten | |
| D518,990 | S * | 4/2006 | Brogden | D6/603 |
| 7,246,392 | B2 * | 7/2007 | Schmid | A41B 13/06 5/655 |
| 7,587,769 | B1 | 9/2009 | McDermott | |
| 7,681,261 | B1 * | 3/2010 | O'Neill | A41B 13/06 2/69.5 |
| 8,191,189 | B1 * | 6/2012 | Spell | A47G 9/083 5/655 |
| 8,863,329 | B2 | 10/2014 | Gangan et al. | |
| D728,198 | S * | 5/2015 | Barski | D2/719 |
| D776,900 | S * | 1/2017 | Bopanna | D2/719 |
| 10,455,865 | B2 * | 10/2019 | Barski | A47G 9/083 |
| D883,613 | S * | 5/2020 | Damir | D2/719 |
| 11,147,318 | B2 * | 10/2021 | Hilton | A41D 10/00 |

(Continued)

FOREIGN PATENT DOCUMENTS

| | | | | |
|---|---|---|---|---|
| TW | M516319 U | * | 2/2016 | A41B 13/06 |
| TW | M553125 U | * | 12/2017 | A41B 13/06 |

*Primary Examiner* — Robert H Muromoto, Jr.
(74) *Attorney, Agent, or Firm* — Warner Norcross + Judd LLP

(57) ABSTRACT

A swaddling garment, such as for swaddling a baby or use as a compression garment, includes a one-piece body having a yoke, arm-receiving sleeves, and a torso-receiving tube defining a torso-receiving space. The swaddling garment is a one-piece, seamless, or/or knit swaddle, without closures, configured to snugly receive a wearer's torso and arms.

19 Claims, 6 Drawing Sheets

(56) References Cited

U.S. PATENT DOCUMENTS

| | | | | |
|---|---|---|---|---|
| 11,659,870 | B2 * | 5/2023 | Damir | A47G 9/083 2/69.5 |
| 11,812,795 | B2 * | 11/2023 | Damir | A41B 13/065 |
| D1,092,007 | S * | 9/2025 | Lim | D2/719 |
| 2012/0110716 | A1 * | 5/2012 | Christensen | A41B 13/06 2/69.5 |
| 2013/0139290 | A1 * | 6/2013 | Barski | A41B 13/06 2/69.5 |
| 2013/0160181 | A1 * | 6/2013 | Mohr | A41B 13/06 2/69 |
| 2013/0283527 | A1 | 10/2013 | Houston et al. | |
| 2018/0020750 | A1 | 1/2018 | Nam | |
| 2018/0103689 | A1 * | 4/2018 | DeLisa | A41B 13/06 |
| 2018/0228222 | A1 * | 8/2018 | Barski | A41B 13/06 |
| 2018/0317566 | A1 * | 11/2018 | Barski | A41B 13/06 |
| 2018/0338868 | A1 * | 11/2018 | Biddulph | A61F 13/085 |
| 2019/0254355 | A1 * | 8/2019 | Griffin | A41B 13/005 |
| 2019/0274366 | A1 * | 9/2019 | Hilton | A41D 10/00 |

* cited by examiner

SWADDLING GARMENT

CROSS-REFERENCE TO RELATED APPLICATION(S)

The present application claims priority to U.S. Provisional Application No. 63/651,141, filed May 23, 2024, which is incorporated herein by reference in its entirety.

BACKGROUND

The present invention relates to swaddling garments or swaddles, including infant swaddles and other compression garments.

Swaddling is the practice of snugly wrapping an infant in a thin blanket or sheet, to help them feel safe and secure. Infants typically do not sleep through the night, and swaddling can help them sleep longer. Feeling held and snug can help to calm and soothe an infant and can reduce excessive crying. Swaddling can also be part of deep pressure therapy that provides firm tactile sensory input to the wearer and provides proprioceptive input to the whole body.

Blanket or sheet swaddles can easily come loose with improper wrapping technique, and infants can even learn to escape a swaddle, either of which eliminates any value swaddling may provide. A loose swaddle also potentially poses a suffocation hazard. However, swaddling too tightly can affect mobility and development. Some ready-made swaddles include hook and loop type fasteners or zipper closures. Often, these can be difficult to use properly and easy for an infant to escape. Since infants are not yet capable of regulating their own body temperature, infants can also become overheated in a swaddle without careful monitoring.

FIG. 1 is a representative view of an infant 14 wearing a prior art swaddling garment 10 disclosed in U.S. Pat. No. 11,147,318, issued Oct. 19, 2021. The swaddling garment 10 includes a tubular body 12, arm sleeves 16 formed within the tubular body 12 for receiving the arms of the infant, and a torso-receiving space 18 within the tubular body 12 between the arm sleeves 16 for receiving the torso of the infant. The tubular body 12 has a neck opening 20 that provides an access opening through which the infant 14 is inserted into and removed from the garment 10. The body 12 has a closed bottom 22 and an envelope fold 24 for accessing the legs and lower torso of the infant. With the infant's arms held at their sides within the tubular body 12 by the arm sleeves 16, the swaddling garment 10 can stop an infant from being disturbed by their own Moro reflex, an infantile reflex normally present in all infants up to 3 or 4 months of age as a response to a sudden loss of support, when the infant feels as if it is falling and causes their arms to spread, which can in turn wake the infant from sleep.

However, past 3 or 4 months of age, the Moro reflex naturally disappears, and some infants may no longer be soothed by arm restriction. Around this time, infant sleep cycles change as their circadian rhythm develops, which can lead to a sleep regression with more frequent waking and difficulty falling sleep. Along these lines, the development of new motor skills including rolling over, sitting, and crawling can lead to sleep regressions. There is a need for an improved swaddling garment for the next phases of infant development.

BRIEF SUMMARY

The present invention provides swaddling garment, such as an infant swaddle or compression garment. In one embodiment, the swaddling garment includes a one-piece, seamless, knit body defining an interior volume, the body having a yoke configured to encircle a wearer's neck and fits over the shoulders of a wearer, the yoke having a circular neck opening into the interior volume, a first arm-receiving sleeve extending from a first lateral end of the yoke, the first arm-receiving sleeve defining an arm-receiving space and having a first arm entry opening, a second arm-receiving sleeve extending from a second lateral end of the yoke, the second arm-receiving sleeve defining an arm-receiving space and having a second arm entry opening, and a torso-receiving tube adjoined to a lower end of the yoke, the torso-receiving tube defining a torso-receiving space.

In some embodiments, the swaddling garment is a one-piece, seamless, or/or knit swaddle configured to snugly receive a wearer's torso and cover a portion of the wearer's shoulders. Zero closures are required to secure the swaddling garment.

In certain embodiments, the swaddling garment can be made from a stretchable knit textile material using a 3D additive manufacturing process or 3D knitting.

In certain embodiments, the swaddling garment has long sleeves, short sleeves, or tank straps.

In certain embodiments, the swaddling garment has a tubular lower portion at a lower end of the torso-receiving tube, wherein the tubular lower portion defines a leg-receiving space and has a larger diameter than the torso-receiving tube.

In certain embodiments, the swaddling garment has a first leg-receiving tube at a lower end of the torso-receiving tube, the first leg-receiving tube defining a leg-receiving space and having a first leg entry opening, and a second leg-receiving tube at a lower end of the torso-receiving tube, the second leg-receiving tube defining a leg-receiving space and having a second leg entry opening, wherein the torso-receiving tube has a larger diameter than the first leg-receiving tube and a larger diameter than the second leg-receiving tube.

In certain embodiments, the swaddling garment has at least one port opening providing access to the interior volume of the body.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT(S)

Figure 2:
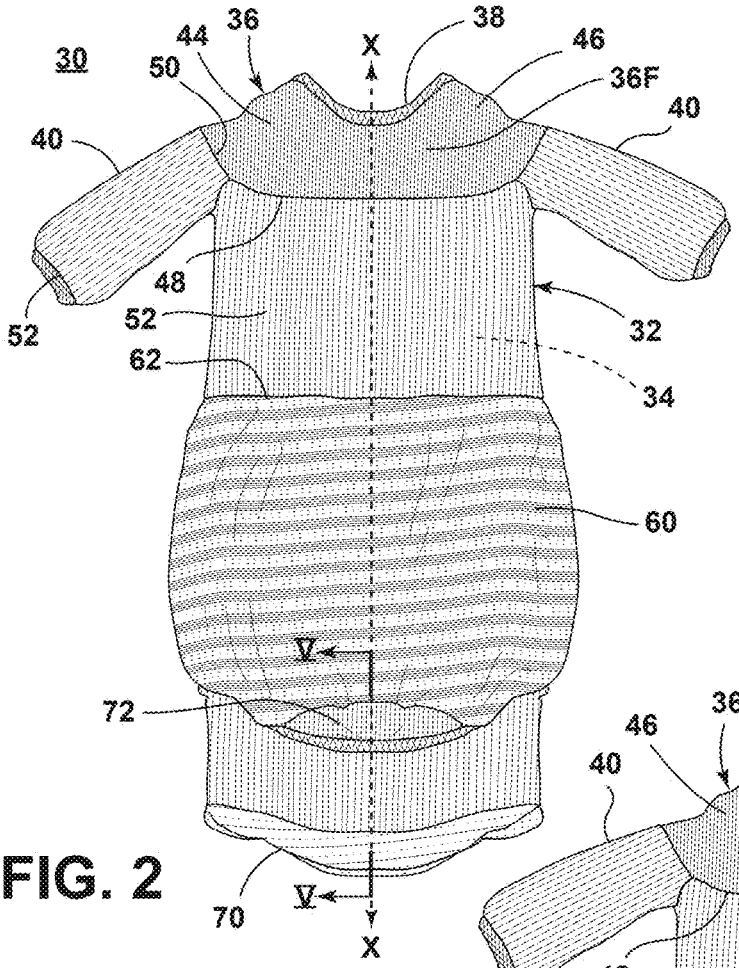
FIG. 2 is a front view of a swaddling garment according to a first embodiment.
Figure 3:
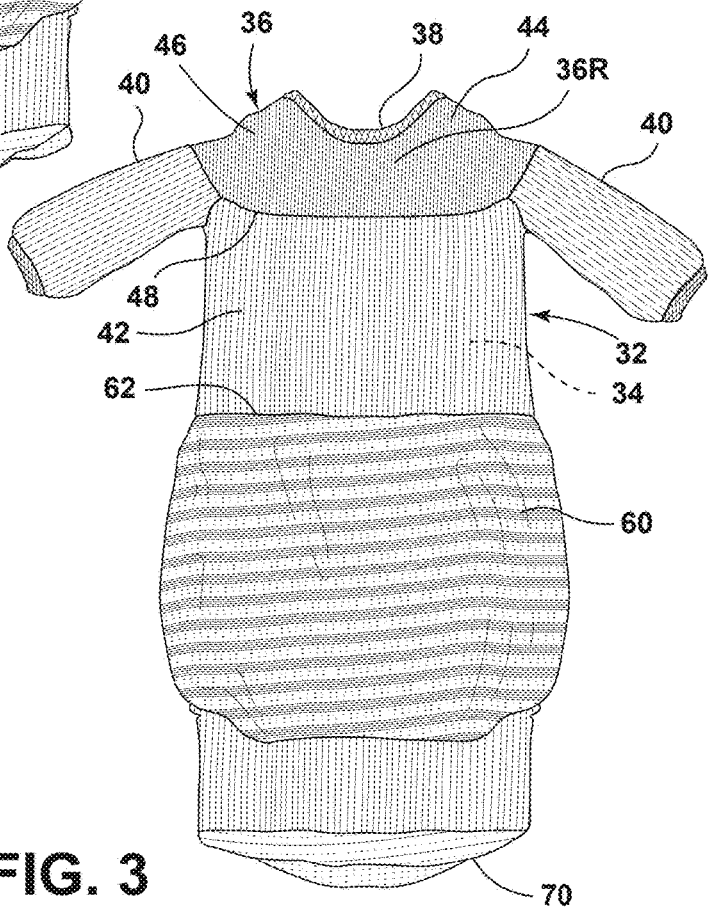
FIG. 3 is a rear view of the swaddling garment of FIG. 2.
Figure 4:
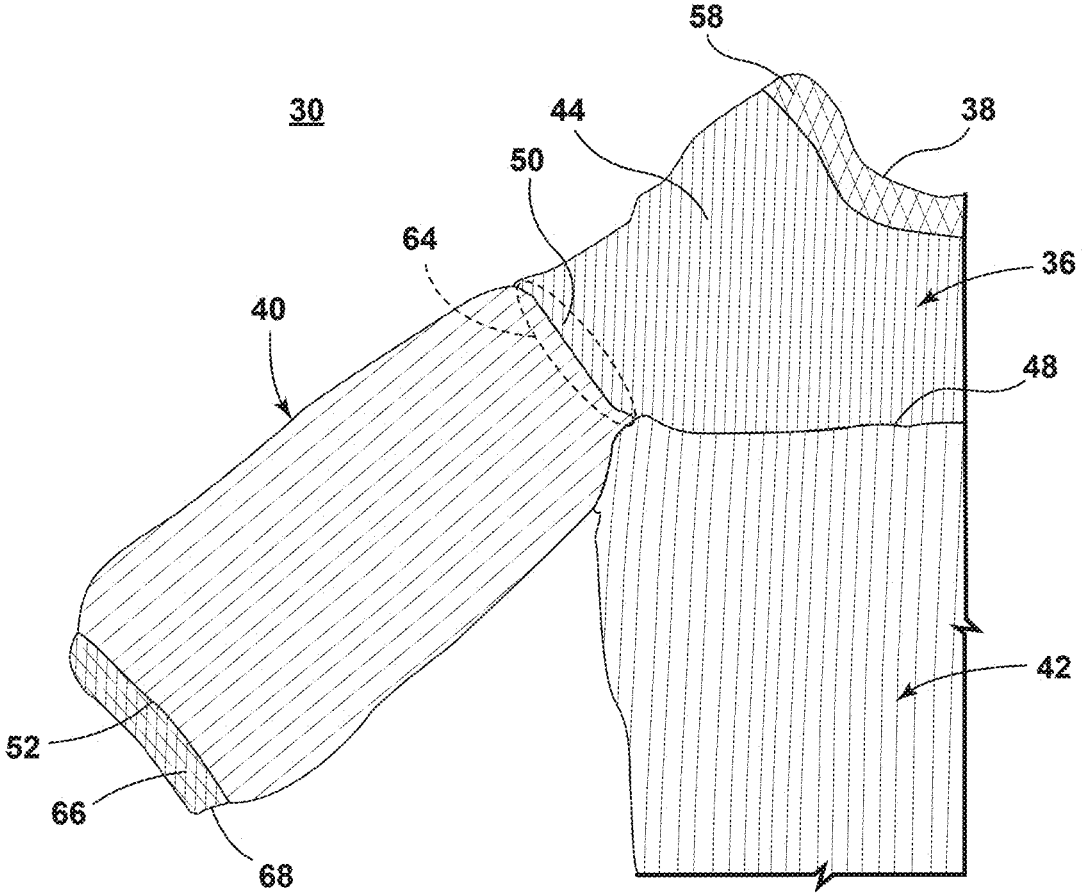
FIG. 4 is a close-up view of a sleeve of the swaddling garment of FIG. 2.

A swaddling garment according to one embodiment of the present invention is shown in FIGS. 2-4 and generally designated 30. The swaddling garment 30 can be an infant swaddle that provides light compression to the infant wearer. In the illustrated embodiment, the swaddling garment 30 can include a one-piece, seamless, knit body 32 defining an interior volume 34 (indicated in phantom line in FIGS. 2-3), a yoke 36 having a circular neck opening 38 into the interior volume 34, arm-receiving sleeves 40 for receiving the arms of the wearer, and a torso-receiving tube 42 for receiving the torso of the wearer, as described in further detail below.

The swaddling garment 30 in the current embodiment is a one-piece, seamless knit swaddle configured to snugly receive a wearer's torso and arms to help them feel safe and secure, and to keep the wearer's arms down throughout the night. In being seamless, the garment 30 has no seams, and does not include any lines formed by sewing pieces of textile material together. Rather, the swaddling garment 30 is smoothly continuous, e.g., by being a continuously-knit garment. Zero closures are required to secure the swaddling garment 30, making the swaddling garment 30 easier to use and more convenient for a caregiver and more escape-proof. The swaddling garment 30 can be made from a stretchable knit material using a 3D additive manufacturing process, providing the ability to easily create the garment without closures, and optionally from multiple different yarns simultaneously.

The swaddling garment 30 is engineered with sleeves 40 to allow movement of the infant's arms while still providing compression to the infant's arms, as well as to the chest via the torso-receiving tube 42, so the infant feels he/she is receiving a hug, thereby encouraging maximum sleep. In one example, the swaddling garment 30 can be configured to apply a compression of ≤10 mmHg to the infant.

The swaddling garment 30 is constructed from a textile material. A textile material is an article manufactured from strands, such as threads cables, yarn, fibers, filaments, cords, and other strand like elongated structures. Strands can be characterized by their fineness, flexibility, and a generally high ratio of length to thickness. Some conventional strands have an indefinite length and can be combined with other strands to produce a yarn for use in the textile material. Some strands include synthetic and/or polymeric materials such as nylon, rayon, polyester and/or polyacrylic compounds. Other strands include wool, cotton, bamboo and/or other or natural materials. Textile materials can be produced directly from certain strands by randomly interlocking the same to construct non-woven fabrics and felts. Alternatively, textile materials can be produced through machine implemented mechanical manipulation of strands, thereby producing knitted material. In one example, the swaddling garment 30 can be made from any textile material suitable for use in swaddling an infant while providing warmth to the infant.

The textile material from which the swaddling garment 30 is constructed can be produced by manipulating strands, using various techniques implemented on a machine, rather than performed manually, by a human. One technique is knitting, which includes interlooping strands in a series of connected loops, optionally forming multiple rows of intermeshing loops. The knitting process can be any of a variety of different knitting processes, for example circular knitting, tubular knitting, flat knitting, sweater knitting, Jacquard knitting, Intarsia knitting, weft knitting, warp knitting and other types of knitting. Other techniques for producing the textile material for the swaddling garment 30 include weaving, crocheting, knotting, felting, or braiding.

In one specific embodiment, the swaddling garment 30 is constructed using 3D additive manufacturing or 3D knitting. This technology allows for the swaddling garment 30 to have inherent zones of different qualities, stretch characteristics, and behaviors in isolated areas without needing any post knit process. Using 3D knitting, the swaddling garment 30 can be constructed from light compression yarns and without seams to simulate a hug while also knitting a different construction that allows the infant's arms to comfortably slip in and stay down. In one example, the 3D knit swaddling garment 30 can be configured to apply a compression of ≤10 mmHg to the infant.

The textile material used for the swaddling garment 30 is preferably a high-stretch material, such as a knit jersey. In one specific embodiment, the swaddling garment 30 is knit with a nylon core spun around a spandex core. Other suitable yarns include nylon or bamboo. Alternatively, the swaddling garment 30 can be knit with any yarn or strand that has some stretch. This includes moisture wicking yarns, anti-microbial yarns, and yarn technology with thermal body temperature management, including yarn that can help to keep the baby's body temperature at 37.5° C. In other embodiments, low-stretch materials such as cotton and fleece can be used. A knit cotton or polyester fleece are examples of suitable low-stretch materials.

In one embodiment, at least the sleeves 40 and the torso-receiving tube 42 of the swaddling garment 30 are constructed from a high-stretch material having a stretch and recovery of 100% in width and 50% in length. Other regions of the swaddling garment can have a similar stretch/recovery, can be configured to stretch more, or can be configured to stretch less.

While being constructed from a unitary textile material, the different regions of the swaddling garment 30 can have different physical and/or mechanical properties, for example, different elasticity, different stretch, different three-dimensional or two-dimensional shape(s), different air permeability or flow, different compression, different weight, different texture, and/or different heat retention. Further, the strands in the different regions can be constructed from different material to import the different physical and/or mechanical properties. In other embodiments, the different regions of the swaddling garment 30 can have the same physical and/or mechanical properties, and/or use only one strand type or yarn type per region.

The creation of the different regions can be accomplished in a number of manners. In one, different strand manipulation techniques, for example, different knitting stitches can be used to achieve variation in properties. For example, different knitting stitches can be used to achieve variation in compression, air permeability, stretch, and recovery. A low-stretch or high compression region can be formed using a tighter stitch. Where low heat retention is desired, such as to prevent an infant from becoming overheated, a high airflow region can be produced by using a looser or more open stitch. The stitch constructions for different regions of the swaddling garment 30 can be manipulated by changing single jersey areas to double jersey or rib areas, half gauging the design, using inlay, changing around tuck, misses, and knit stitches. Different strands (i.e., type, texture, and twist) and different needle sizes can also be used to achieve variation in properties.

The yoke 36 encircles a wearer's neck and fits over the shoulders of the wearer, with the neck opening 38 receiving the head and neck of the wearer. The yoke 36 is generally a region the garment 30 that fits around the neck and over the shoulders and adjoins proximal ends of the sleeves 40. The sleeves 40 are formed at laterally opposed ends of the yoke 36 (e.g., near the shoulders), with one sleeve 40 extending from a first lateral end 44 of the yoke 36 and the other sleeve 40 extending from a second lateral end 46 of the yoke 36.

The yoke 36 has a front region (or front yoke portion) 36F and a back region (or back yoke portion) 36R. The front and back regions 36F, 36R are continuous, extending between both sleeves 40 and extending from the neck opening 38 down to the torso-receiving tube 42.

The front region 36F generally covers the upper chest and the back region 36R generally covers the upper back of the wearer's torso when the garment 30 is worn by a wearer. In particular, the yoke 36 covers the wearer above a torso transition line 48 encircling the upper chest and upper back at the underarm area of the wearer. The torso-receiving tube 42 covers the wearer below the torso transition line 48.

The yoke 36 can also cover the wearer's shoulders when the garment 30 is worn by a wearer. In particular, the yoke 36 covers the wearer's shoulders, and in some embodiments a portion of the wearer's upper arms, above upper sleeve transition lines 50 encircling each upper arm of the wearer. The sleeves 40 can also have lower sleeve transition lines 52 encircling the arm of the wearer at a location spaced from and below the upper sleeve transition line 50. The sleeves 40 cover the wearer's arms between the upper and lower sleeve transition lines 50, 52.

The yoke 36, sleeves 40, and torso-receiving tube 42 can each have a set of physical and/or mechanical properties, for example, elasticity, stretch, air permeability, compression, weight, texture, and/or heat retention. Each region can have a set of properties that enable the different regions of the one-piece swaddling garment 30 to have functional variability. As an example of differences between the regions, the sleeves 40 and torso-receiving tube 42 can include knit stitches that impart a different compression than the knit stitches of the yoke 36; for example, the sleeves 40 and torso-receiving tube 42 can provide more compression than the yoke 36.

The body 32 can transition to a region of higher compression below or distal of the torso transition line 48 to apply higher compression to the portion of the body covered by the torso-receiving tube 42, e.g., the wearer's torso, with the yoke 36 applying lighter compression or no compression to the portion of the body covered by the yoke 36, e.g., the wearer's upper chest and upper back.

The body 32 can transition to a region of higher compression below or distal of the upper sleeve transition line 50 to apply higher compression to the portion of the wearer's arm covered by the sleeve, e.g., the wearer's arm, with the yoke 36 applying lighter compression or no compression to the portion of the body covered by the yoke 36, e.g., the wearer's shoulders, as well as the wearer's upper chest and upper back.

The sleeves 40 and torso-receiving tube 42 can apply approximately the same amount of compression to the body of the wearer and may be constructed using the same knitting stitches to achieve the same compression, and may further have the same air permeability, stretch, and recovery. In one example, the sleeves 40 and torso-receiving tube 42 can be configured to apply 10-40 mmHg of compression to the wearer, and the yoke 36 can be configured to apply less than 10 mmHg of compression to the wearer. In another example, the torso-receiving tube 42 can be configured to apply a compression of about 10 mmHg to the torso of the wearer, the sleeves 40 can be configured to apply a compression of about 10 mmHg to the arms of the wearer, and the yoke 36 can be configured to apply a compression of about 8 mmHg to the upper chest, upper back, and shoulders.

It is noted that the patterns depicted in the different regions of the swaddling garment 30 are but one example, and that in other embodiments of the swaddling garment 30, the different regions can be constructed with other patterns, strand or yarn types, strand or yarn combinations, and/or knitting stitches.

With reference to FIGS. 2-3, the interior volume 34 is sized and shaped for receiving at least the arms and torso of the wearer. In the illustrated embodiment, the interior volume 34 is further configured to receive the legs of the wearer. The body 32 includes a first or head end and a second or foot end opposite the head end.

When viewed from the front and substantially lying flat as shown in FIG. 2, the body 32 can be straight between the head end and foot end, can taper toward one of the ends or both ends, or can widen toward one of the ends or both ends. Still other shapes for the body 32 are possible. In the embodiment shown in FIG. 1, the body 32 is widest below the torso transition line 48 and tapers toward the foot end.

The neck opening 38 provides an access opening through which the wearer can be inserted into and removed from the interior volume 34 of the body 32. The neck opening 38 can be stretchable to enable the neck opening 38 to be passed over the infant's body. When the swaddling garment 30 is worn by an infant, the head and neck of the infant project from the neck opening 38. The neck opening 38 can be circular, and can be a continuous, uninterrupted edge at the head end of the garment 30. Optionally, the neck opening 38 can have a collar band 58 to define a finished final edge of the knitted garment 30 and requires no further sewing or finishing on this edge.

In some embodiments, the swaddling garment 30 can include no other openings other than the neck opening 38 and sleeves 40 for providing access to the interior volume 34 of the body 32. In other embodiments, the swaddling garment 30 can include at least one other opening for accessing the legs and lower torso for diaper changing, foot openings for through which the foot of the leg can protrude from the body 32, at least one port opening for for medical treatment or monitoring, or any combination thereof, as described in further detail below.

The body 32 can have a tubular lower portion 60 at a lower end of the torso-receiving tube 42 and can define the foot end. The tubular lower portion 60 can be substantially aligned with infant's hips, legs, and/or feet, and can define a leg receiving space. In particular, the tubular lower portion 60 covers the wearer below a lower torso transition line 62 encircling the lower torso and/or hips of the wearer. The torso-receiving tube 42 covers the wearer above the torso transition line 62.

The lower portion 60 is sized and shaped to fit more loosely than the torso-receiving tube 42 to provide the legs of the wearer with sufficient space to flex and abduct at the hips. For example, the tubular lower portion 60 has a larger diameter than the torso-receiving tube 42. Because the wearer's hips and legs are not restricted by the lower portion 60 of the garment 30, improper muscle development in the lower body and hip dysplasia do not result from using the garment 30. As an added benefit, having the lower portion 60 loosely fitted with the infant allows easier access for diaper changing, as described in further detail below.

In addition to increasing diameter, the body 32 can transition from a region of higher compression above the lower torso transition line 62 to a region of lighter compression below the lower torso transition line 62 apply lower compression or no compression to the portion of the body covered by the tubular lower portion 60, e.g., the wearer's hips and legs.

The body 32 can be symmetrical about a longitudinal axis X as shown in FIG. 2, with the longitudinal axis X defining a midline of the body 32, and the sleeves 40 disposed laterally with respect to the midline.

Referring to FIG. 4, the sleeves 40 define arm-receiving spaces in which the wearer's arms can be received and snugly held. The sleeves 40 are tubular, with a proximal opening 64 (indicated in phantom line in FIG. 4) at the yoke 36 and a distal opening 66 spaced from the proximal opening 64 relative to a generally longitudinal axis running lengthwise along the sleeve 40. The sleeves 40 are external to the torso-receiving tube 42. The garment 30 shown in FIGS. 2-4 is a "long-sleeved" garment, with the sleeves 40 covering a wearer's arm to their wrist. Other sleeve lengths are possible.

The proximal opening 64 provides an arm entry opening through which an arm can be inserted into and removed from the sleeve 40. In at least some embodiments, the proximal opening 64 can fit in the wearer's armpit and can prevent the swaddling garment 30 from riding up. The distal opening 66 can define a hand opening through which the hand of the arm can protrude from the sleeve 40.

In some embodiments, the sleeve can have a cuff 68 forming the distal opening 66. The cuff 68 can encircle the wearer's arm below the lower sleeve transition line 52, e.g., at the wrist area. The sleeve 40 can transition to a region of lighter compression below or distal of the lower sleeve transition line 52 to apply lower compression or no compression to the area of the wearer's arm covered by the cuff 68. The cuff 68 can be stretchable to enable the distal opening 66 to be passed over the wearer's hand.

The various regions of the one-piece swaddling garment 30 transitions smoothly to one another at the transition lines 48, 50, 52, 62. At the transition lines 48, 50, 52, 62, there is no seam or other separately constructed fastener connecting the different regions of the garment 30. Instead, the different regions of the garment 30 simply transition to one another by modifying the knitting and/or weaving pattern or structure from one region to the next, without adding a separately constructed attachment element to the unitary textile material. Other similar transitions can be included between other regions of the swaddling garment 30.

Figure 1:
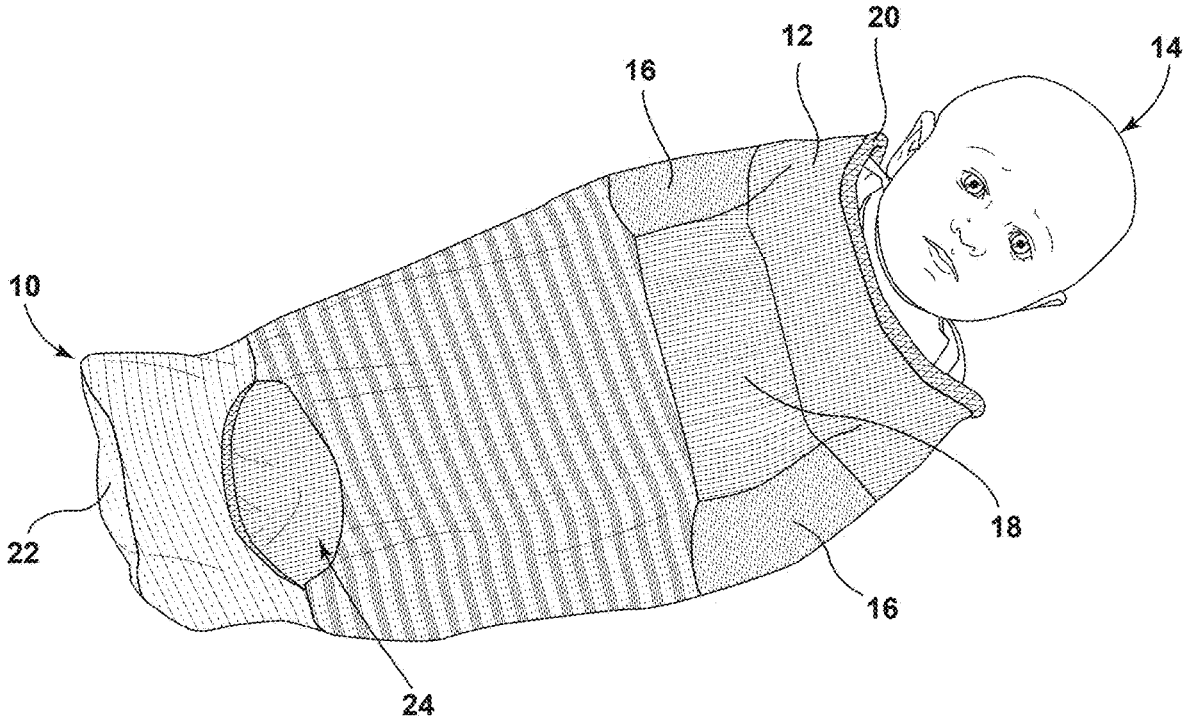
FIG. 1 (PRIOR ART)
FIG. 1 is a representative view of an infant wearing a prior art swaddling garment.
Figure 5:
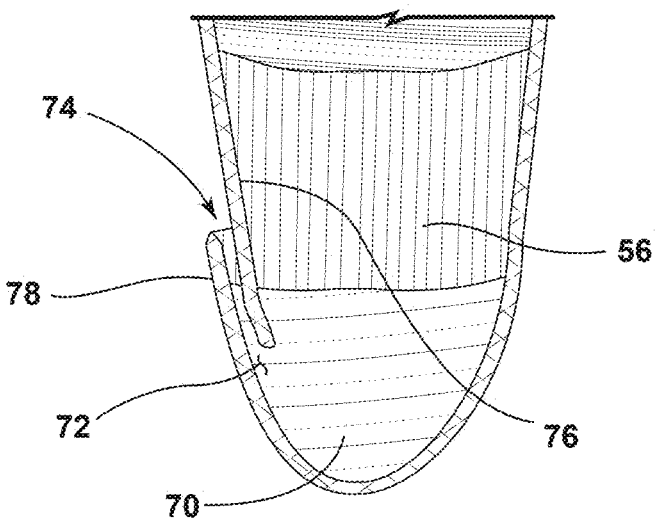
FIG. 5 is a cross-sectional view of the swaddling garment of FIG. 2 taken through line V-V of FIG. 2.

Referring to FIGS. 1 and 5, the foot end or lower portion 60 of the body 32 can be closed, open, or, as shown in the illustrated embodiment, have a closed bottom 70 with an access opening 72 spaced above the closed bottom 70, which is convenient for diaper changes. The garment 30 can have an envelope fold 74 for accessing the legs and lower torso of the wearer. In particular, the envelope fold 74 permits a portion of the garment 30 to be folded back on itself, for example to change a diaper, without completely removing the garment 30, or even uncovering the torso and arms of the wearer.

In one embodiment, the envelope fold 74 can be formed by overlapping inner and outer flaps 76, 78, respectively, to create a pouch in which the infant's lower legs and/or feet are received. The outer flap 78 extends over at least a portion of the inner flap 76 to cover the access opening 72 so that the wearer's feet will remain securely swaddled and warm within the garment 30. The outer flap 78 can easily be pulled down and around the infant's feet, allowing the infant's feet to pass through the access opening 72 and the lower end of the swaddling garment 30 to be bunched up for a diaper change.

The flaps 76, 78 can be stretchable to enable lower end of the swaddling garment 30 to be passed over the infant's body. In embodiments where the swaddling garment 30 is a knit garment, an edge of the flaps 76, 78 can be formed by a bind-off to define a finished final edge of the knitted garment 30 and requires no further sewing or finishing on the edge.

In some embodiments, the flaps 76, 78 can be the sole area of overlapping layers of textile material or fabric on the swaddling garment 30. Otherwise, the swaddling garment 30 can be made from one layer of textile material or fabric. In other embodiments, the entire swaddling garment 30 may be made from one layer, such that the infant or wearer has only one layer of textile material or fabric on a given area of their body. With such an embodiment, the foot end or lower portion 60 of the body 32 may be closed or open, rather than comprising an envelope fold.

The swaddling garment 30 also functions as a blanket to keep the infant warm, and the substantially single layer, knitted construction prevents the infant from becoming overheated. The seamless, sack-like design involving no closures allows a caregiver to easily slide the infant into and out of the swaddling garment 30.

To insert the infant into the swaddle, the yoke 36 and torso-receiving tube 42 are stretched around the infant's legs and the torso-receiving tube 42 is pulled up around his or her torso. Next, the infant's arms are slid into the sleeves 40. The yoke 36 is settled around the shoulders of the infant, with the neck opening 38 resting at his or her shoulders or neck. Zero closures are required to secure the swaddling garment 30.

A method for manufacturing the swaddling garment 30 will now be described. Generally, the one-piece swaddling garment 30 can be constructed from multiple strands. These strands can be manipulated to form the textile, for example, by knitting (which can encompass intertwining and/or twisting) the strands.

As the swaddling garment 30 the is constructed, the yoke 36, sleeves 40, torso-receiving tube 42 and any other regions, having different sets of properties as described above, are formed integrally within the unitary textile material. In most cases, the yoke 36, sleeves 40 and torso-receiving tube 42 are not sewn, adhered, glued, or otherwise fastened to one another. Instead, the structure of the unitary textile material joins the different regions at an intersection as described above, such as transition lines 48, 50, 52, 62, so that the different regions are contiguous and uninterrupted.

Optionally, the yoke 36 can be less densely knitted and more stretchable or elastic than the sleeves 40 and torso-receiving tube 42. Other regions of the swaddling garment 30 can likewise be less densely knitted and more stretchable or elastic than the sleeves 40 and torso-receiving tube 42, with different physical and/or mechanical properties and associated performance characteristics and/or attributes associated with different regions or sections of the swaddling garment 30.

The swaddling garment 30 can be constructed from a plurality of strands that can be knitted or woven in a network with one another, or alternatively non-woven. The strands can be in the form of threads, cables, yarn, fibers, filaments, cords and other strand-like elongated structures. The strands can be constructed from a material, such as a thermoplastic polymer material or other polymeric or natural materials. As an example, thermoplastic polymer strands can be constructed from a variety of materials such as nylon, polyurethane, polyester, polyester polyurethane, polyether polyurethane, other polymeric materials, and combinations thereof.

Optionally, multiple different types of strands can be knitted with one another integrally to form the swaddling garment 30. For example, the swaddling garment 30 can be constructed using a first strand and a second strand. The first strand can be constructed to have a first mechanical or physical property, such as a first elasticity. The second strand can be constructed to have a second mechanical or physical property. For example, the second strand can have a second elasticity than is greater than the first elasticity.

The swaddling garment 30 can be constructed on a knitting machine. In one embodiment, the swaddling garment 30 can more particularly be constructed using flatbed weft knit technology, with the pattern for the swaddling garment 30 programmed on 3D knitting software and then constructed in a one-step process using a flatbed weft knitting machine.

The swaddling garment 30 can be knitted using a single knit stitch type. Alternatively, multiple different knit stitch types can be utilized so that different regions of the garment 30 exhibit different physical and/or structural properties, for example, different compression, air permeability, stretch, recovery, etc. The stitch constructions can be manipulated by changing single jersey areas to double jersey or rib areas, half gauging the design, using inlay, changing around tuck, misses, and knit stitches.

While the swaddling garment 30 may be knit, in an alternate embodiment, the swaddling garment 30 can be comprised of multiple patchwork pieces that are sewn, stitched, glued, adhered, fused, melted, and/or thermally bonded. In yet another embodiment, the swaddling garment 30 can be comprised of a weave or a mesh.

Figure 6:
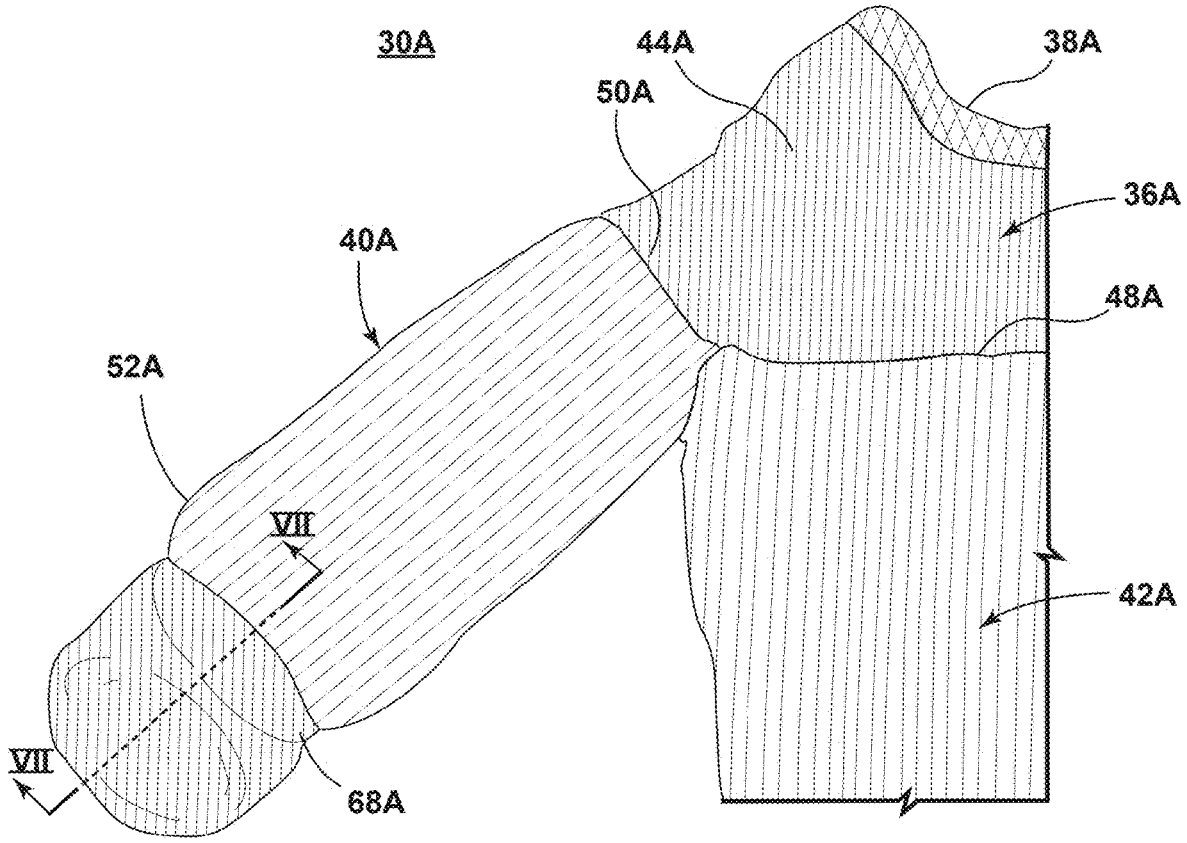
FIG. 6 is a close-up view of a second embodiment of the swaddling garment.
Figure 7:
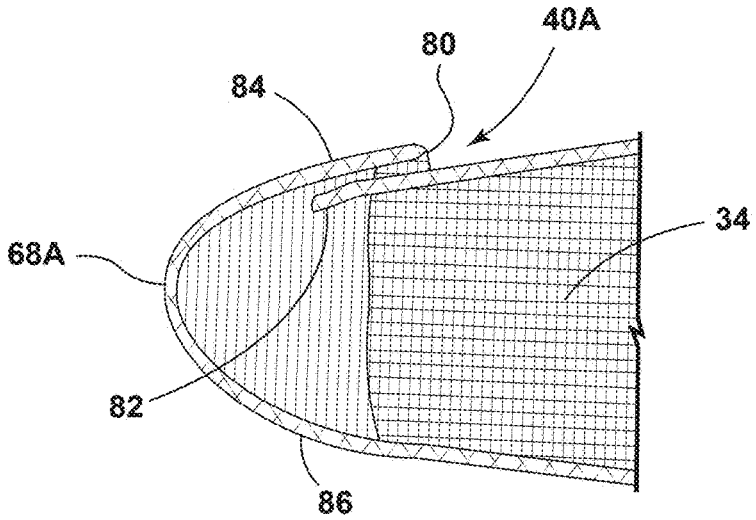
FIG. 7 is a cross-sectional view of the sleeve of FIG. 6 taken through line VII-VII of FIG. 6.

A swaddling garment 30A according to a second embodiment of the invention is shown in FIGS. 6-7. The swaddling garment 30A can be substantially similar to the swaddling garment 30 of the first embodiment, and like elements are referred to by the same reference numerals bearing the letter "A." The swaddling garment 30A differs from the first embodiment by having sleeves 40A with foldover mitten cuffs 68A. The mitten cuffs 68A can fold over the wearer's hands to prevent it from scratching its face and to keep them warm so that he/she can sleep comfortably. The mitten cuffs 68A can be folded up and out of the way when needed to allow the wearer or the wearer's caregiver access to the wearer's hands without requiring a garment change. FIG. 6 shows the sleeve 40A at the first lateral end 44A of the yoke 36A. A similar sleeve 40A at the second lateral end of the yoke 36A is present but is not depicted in FIG. 6.

The mitten cuff 68A can comprise a closed distal end of the sleeve 40A having an envelope fold 80 formed by overlapping inner and outer flaps 82, 84 and a backing flap 86, opposite the envelope fold 80. The backing flap 86 may be continuously formed with the outer flap 82. The outer flap 84 is dimensioned so that when it is in the closed position, it overlaps a significant portion of the inner flap 84. The cuff 68A is opened by turning the outer flap 84 back on itself to hold over the backing flap 86 to allow access to the interior of the sleeve 40.

When closed, the mitten cuff 68A can cover the wearer's hand below the lower sleeve transition line 52A. The sleeve 40A can transition to a region of lighter compression below or distal of the transition line 52A to apply lower compression or no compression to the portion of the body covered by the mitten cuff 68A, e.g., the wearer's hand.

The flaps 82, 84 can be stretchable to enable distal end of the sleeve 40A to be passed over the wearer's hands. In embodiments where the swaddling garment 30A is a knit garment, an edge of the flaps 82, 84 can be formed by a bind-off to define a finished final edge of the knitted garment 30A and requires no further sewing or finishing on the edge.

Figure 8:
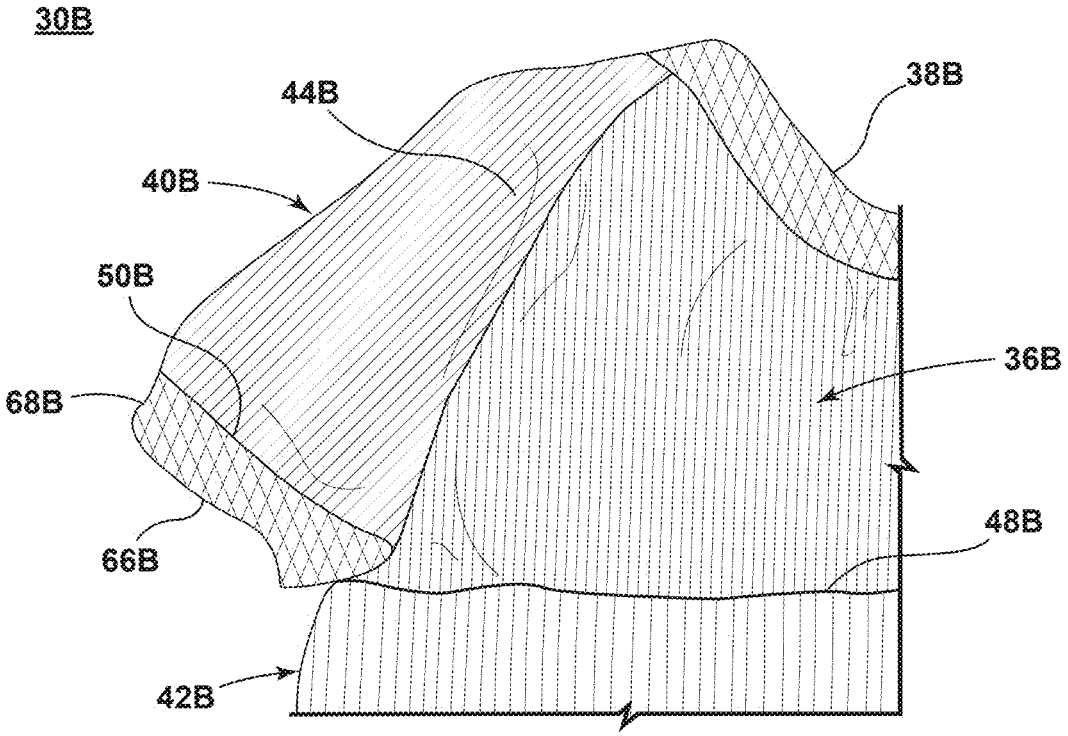
FIG. 8 is a close-up view of a third embodiment of the swaddling garment.

A swaddling garment 30B according to a third embodiment of the invention is shown in FIG. 8. The swaddling garment 30B can be substantially similar to the swaddling garment 30 of the first embodiment, and like elements are referred to by the same reference numerals bearing the letter "B." The swaddling garment 30B differs from the first embodiment in comprising a "short-sleeved" garment, with short sleeves 40B covering a wearer's upper arms. The distal opening 66B can define an upper arm opening through which the upper arm can protrude from the sleeve 40B. The cuff 68B can encircle the wearer's upper arm below the sleeve transition line 50B. FIG. 8 shows the sleeve 40B at the first lateral end 44B of the yoke 36B. A similar sleeve 40B at the second lateral end of the yoke 36C is present but is not depicted in FIG. 8.

In one embodiment, the short sleeves 40B can apply less compression to the body of the wearer than the torso-receiving tube 42B. The short sleeves 40B and yoke 36B can apply approximately the same amount of compression to the body of the wearer and may be constructed using the same knitting stitches to achieve the same compression, and may further have the same air permeability, stretch, and recovery.

Figure 9:
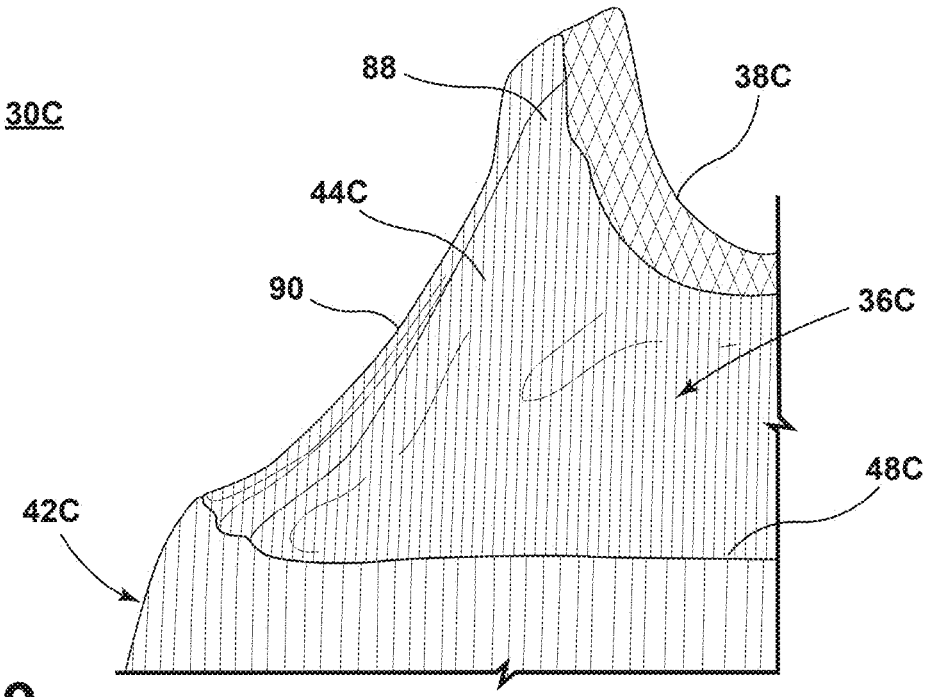
FIG. 9 is a close-up view of a fourth embodiment of the swaddling garment of FIG. 2.

A swaddling garment 30C according to a fourth embodiment of the invention is shown in FIG. 9. The swaddling garment 30C can be substantially similar to the swaddling garment 30 of the first embodiment, and like elements are referred to by the same reference numerals bearing the letter "C." The swaddling garment 30C differs from the first embodiment in comprising a "sleeveless" garment, with no sleeves covering a wearer's arms. Instead, the garment 30C is a "tank top" garment and the yoke 36C has shoulder straps 88 that fit over the shoulders of the wearer. The shoulder straps 88 define openings 90 formed at the laterally opposed ends of the yoke 36C (e.g., near the shoulders) through which an arm can pass, with FIG. 9 showing the opening 90 at the first lateral end 44C of the yoke 36C. A similar strap 88 defining an opening at the second lateral end of the yoke 36C is present but is not depicted in FIG. 9.

Figure 10:
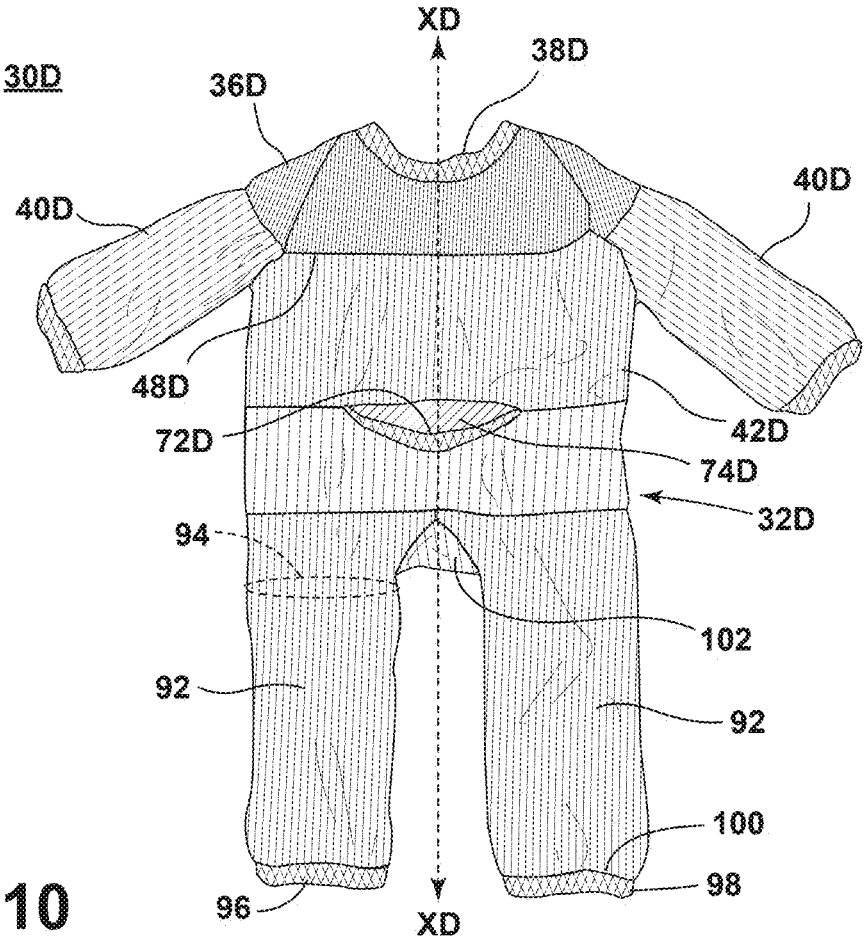
FIG. 10 is a front view of a fifth embodiment of the swaddling garment.

A swaddling garment 30D according to a fifth embodiment of the invention is shown in FIG. 10. The swaddling garment 30D can be substantially similar to the swaddling garment 30 of the first embodiment, and like elements are referred to by the same reference numerals bearing the letter "D." The swaddling garment 30D differs from the first embodiment in the body 32D having first and second leg-receiving tubes 92 for individually receiving the legs of the wearer. The leg-receiving tubes 92 to allow movement of the infant's legs while providing compression to the infant's legs, as well as to the arms via the sleeves 40D and the chest via the torso-receiving tube 42D, so the infant feels he/she is receiving a hug, thereby encouraging maximum sleep. The leg-receiving tubes 92 are sized and shaped to fit more closely to the legs of the wearer while allowing the wearer to flex and abduct at the hips and bend at the knees. The leg-receiving tubes 92D can each have a smaller diameter than the torso-receiving tube 42D.

The sleeves 40D, torso-receiving tube 42D, and leg-receiving tubes 92 can apply approximately the same amount of compression to the body of the wearer and may be constructed using the same knitting stitches to achieve the same compression, and may further have the same air permeability, stretch, and recovery. In one example, the sleeves 40D, torso-receiving tube 42D, and leg-receiving tubes 92 can be configured to apply 10-40 mmHg of compression to the wearer, and the yoke 36D can be configured to apply less than 10 mmHg of compression to the wearer. In another example, the torso-receiving tube 42D can be configured to apply a compression of about 10 mmHg to the torso of the wearer, the sleeves 40D can be configured to apply a compression of about 10 mmHg to the arms of the wearer, the leg-receiving tubes 92 can be configured to apply a compression of about 10 mmHg to the legs of the wearer, and the yoke 36D can be configured to apply a compression of about 8 mmHg to the upper chest, upper back, and shoulders. In this example, at least the sleeves 40D, the torso-receiving tube 42D, and the leg-receiving tubes 92 are constructed from a high-stretch material having a stretch and recovery of 100% in width and 50% in length.

The leg-receiving tubes 92 are at a lower end of the torso-receiving tube 42D, with one leg-receiving tube 92 laterally spaced from the longitudinal axis XD on a first side of the axis XD and the other leg-receiving tube 92 laterally spaced from the longitudinal axis XD on a second side of the axis XD. The leg-receiving tubes 92 can define the foot end of the garment 30D. The body 32D can be symmetrical about the longitudinal axis XD, with the sleeves 40D and leg-receiving tubes 92 being equally spaced from the axis XD.

Each leg-receiving tube 92 defines a leg-receiving space in which the wearer's legs can be received and snugly held. The leg-receiving tubes 92 are tubular, with a proximal opening 94 (indicated in phantom line in FIG. 10) and a distal opening 96 spaced from the proximal opening 94 relative to a generally longitudinal axis running lengthwise along the tube 92. The tubes 92 shown in FIG. 10 cover a wearer's leg to their ankle. Other lengths are possible.

The proximal opening 94 provides a leg entry opening through which a leg can be inserted into and removed from the tube 92. In at least some embodiments, the proximal opening 94 can fit in the wearer's crotch and can prevent the swaddling garment 30D from riding up. The distal opening 96 can define a foot opening through which the foot of the leg can protrude from the tube 92.

In some embodiments, the leg-receiving tube 92 can have a cuff 98 forming the distal opening 96. The cuff 68 can encircle the wearer's arm below a leg transition line 100, e.g., at the ankle area. The leg-receiving tube 92 can transition to a region of lighter compression below or distal of the leg transition line 100 to apply lower compression or no compression to the area of the wearer's leg covered by the cuff 98. The cuff 98 can be stretchable to enable the distal opening 96 to be passed over the wearer's foot.

In some embodiments, the garment 30D includes a crotch gusset 102 adjoined to upper ends of the leg-receiving tubes 92. The gusset 102 strengthens and/or enlarges the crotch region of the garment 30D to add breadth to the space between the leg-receiving tubes 92. The gusset 102 can also be constructed with ventilation and/or moisture wicking properties. The gusset 102 can be square, rhomboidal, or triangular in shape.

The body 32D can have an access opening 72D above the leg-receiving tubes 92, which is convenient for diaper changes. The garment 30D can have an envelope fold 74D for accessing the legs and lower torso of the wearer. In particular, the envelope fold 74D permits a portion of the garment 30D to be folded back on itself to pull the legs of the wearer out of the leg-receiving tubes 92 without completely removing the garment 30D.

Figure 11:
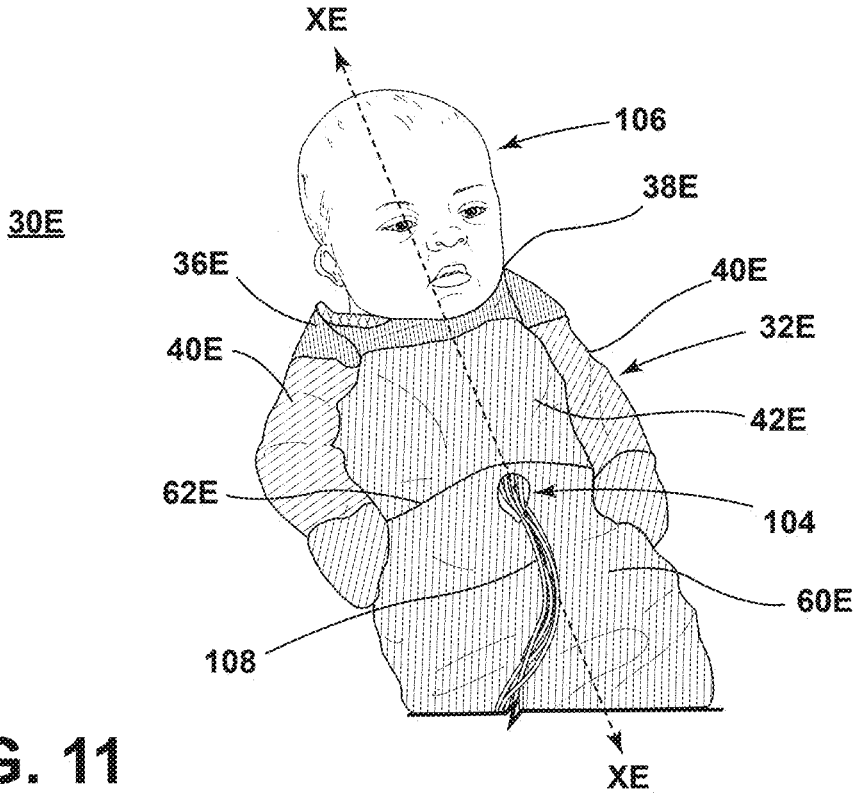
FIG. 11 is a perspective view of an infant wearing a sixth embodiment of the swaddling garment.

A swaddling garment 30E according to a sixth embodiment of the invention is shown in FIG. 11, which depicts an infant 106 swaddled in the garment 30E. The swaddling garment 30E can be substantially similar to the swaddling garment 30E of the first embodiment, and like elements are referred to by the same reference numerals bearing the letter "E." The swaddling garment 30E differs from the first embodiment in the body 32E having at least one, and in some embodiments more than one, port opening 104 for medical treatment or monitoring. Hospitalization of an infant requiring tubes, wires, or other medical devices be connected to the body can prevent swaddling with current ready-made swaddles. In particular, the port opening 104 permits a portion of the garment 30E to be opened, for example for the passage of a tube, wire, or other device, collectively referred to with reference numeral 108, without completely removing the garment 30E, or even uncovering the torso, arms, or legs of the wearer. The garment 30E can be worn by an infant having a gastrostomy tube or telemetry, for example.

Various configurations for the port opening 104 are possible. In one embodiment, the edge defining the perimeter of the port opening 104 can be formed by a bind-off to define a finished final edge of the port opening 104 and requires no further sewing or finishing on the edge. In another embodiment, the garment 30E can have an envelope fold at the port opening 104.

Various locations for the port opening 104 on the garment 30E are possible. It is further noted that one or more port openings 104 can be provided on any embodiment of the swaddling garment disclosed herein, including the garments shown in FIGS. 2-10. In the illustrated embodiment, the port opening 104 is disposed below the lower torso transition line 62E and at an upper end of the tubular lower portion 60E. Other locations include, but are not limited to, at a lower end of the torso-receiving tube 42E above the lower torso transition line 62E, in the yoke 36E, in the sleeve 40E, or in the leg-receiving tube 92 in the case of garment 30D.

The longitudinal axis XE can intersect the port opening 104, such that the port opening 104 is provided at the midline of the garment 30E. Alternatively, the port opening 104 can be offset laterally from the longitudinal axis XE, which is advantageous in cases where the tube or wiring accommodated by the port opening 104 requires a connection to the wearer laterally offset from the midline of the wearer's body.

There are several advantages of the present disclosure arising from the various features of the methods, systems, and apparatus described herein. For example, embodiments of an infant swaddle described herein is a one-piece garment without closures. A caregiver only has to slide the swaddling garment up and around the infant's body and insert their arms and into the sleeves. The swaddling garment makes it particularly easy to swaddle an older infant, despite any wiggling or squirming from the infant. No cumbersome wrapping or closure fastening are required. With no wrapped layers or closures, there is no chance of the swaddle becoming loose enough for the infant to escape. The sleeves allow movement of the infant's arms while still providing compression to the infant's arms, as well as to the chest via the torso-receiving tube 42, so the infant feels he/she is receiving a hug, thereby encouraging maximum sleep. Yet another advantage is that embodiments of the swaddling garment having a port opening allows for infants having feeding tubes and/or telemetry to be comfortably swaddled in the one-piece, seamless, knit garment.

While the swaddling garment of FIGS. 1-11 is shown and discussed for wear by an infant, any embodiment of the swaddling garment 30 disclosed herein can alternatively be sized for wear by a toddler, child, teen, or adult. The swaddling garment disclosed herein can be provided in varying sizes depending on the age of the wearer, and can be sized for newborns, babies, toddlers, children, teens, or adults. Generally speaking, the size range of infant swaddles can range from 0 to 24 months, and more particularly from 0 to 12 months. The stretchy material also stretches to accommodate a range of sizes, including a range of weights and lengths, and accommodates for the growth of an infant without having to purchase more than one size.

As another alternative, any embodiment of the swaddling garment 30 disclosed herein can be a deep pressure therapy garment that provides firm tactile sensory input to the wearer and provides proprioceptive input to the whole body. The compression provided by the deep pressure therapy garment simulates a hug, can produce a calming and/or, organizing effect on the wearer, and relaxes the nervous system. In one example, the swaddling garment 30 can be configured to apply 10-40 mmHg of compression to the wearer.

In yet another embodiment, the swaddling garment 30 disclosed herein can alternatively be configured for wear by a pet or other animal. The swaddling garment 30 can be provided in varying sizes depending on the age size and type of animal. Generally speaking, the swaddling garment 30 covers at least a portion of the front legs and torso of the animal, with the sleeves 40 receiving the front legs of the animal and the torso-receiving tube 42 receiving the torso of the animal.

Directional terms, such as "vertical," "horizontal," "top," "bottom," "upper," "lower," "inner," "inwardly," "outer" and "outwardly," are used herein to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A swaddling garment comprising:

a one-piece, seamless, 3D knit body defining an interior volume, the body comprising:

a yoke configured to encircle a wearer's neck and fits over a wearer's shoulders, the yoke having a circular neck opening into the interior volume;

a first arm-receiving sleeve extending from a first lateral end of the yoke, the first arm-receiving sleeve defining an arm-receiving space and having a proximal opening at the yoke and a distal opening spaced from the proximal opening relative to a generally longitudinal axis running lengthwise along the first arm-receiving sleeve, the proximal opening comprising a first arm entry opening through which one of the wearer's arms can be inserted into and removed from the first arm-receiving sleeve;

a second arm-receiving sleeve extending from a second lateral end of the yoke, the second arm-receiving sleeve defining an arm-receiving space and having a proximal opening at the yoke and a distal opening spaced from the proximal opening relative to a generally longitudinal axis running lengthwise along the second arm-receiving sleeve, the proximal opening comprising a second arm entry opening through which another of the wearer's arms can be inserted into and removed from the second arm-receiving sleeve; and a torso-receiving tube adjoined to a lower end of the yoke, the torso-receiving tube defining a torso-receiving space;

wherein the first and second arm-receiving sleeves are configured to apply compression to the wearer's arms and the torso-receiving tube is configured to apply compression to the wearer's chest;

wherein the first and second arm-receiving sleeves are spaced from and not directly joined to the torso-receiving tube below the yoke such that the first and second arm-receiving sleeves are detached from the torso-receiving tube and the wearer's arms are movable independently of the torso-receiving tube while compression is applied to the wearer's arms and chest;

wherein the swaddling garment encourages sleep by allowing movement of the wearer's arms while providing compression to the wearer's arms via the arm-receiving sleeves and providing compression to the wearer's chest via the torso-receiving tube, so the wearer feels hugged.

2. The swaddling garment of claim 1, wherein the first and second arm-receiving sleeves and the torso-receiving tube are configured to apply a greater compression than the yoke.

3. The swaddling garment of claim 1, wherein the torso-receiving tube is configured to apply greater compression than the yoke, the first arm-receiving sleeve, and the second arm-receiving sleeve.

4. The swaddling garment of claim 1, wherein at least one or more of the first arm-receiving sleeve, the second arm-receiving sleeve, and the torso-receiving tube comprise a single layer of textile material.

5. The swaddling garment of claim 1, comprising a mitten cuff at the distal opening of each of the first and second arm-receiving sleeves, wherein the mitten cuff comprises an envelope fold formed by overlapping inner and outer flaps.

6. The swaddling garment of claim 1, wherein the body comprises a tubular lower portion at a lower end of the torso-receiving tube, wherein the tubular lower portion defines a leg-receiving space and has a larger diameter than the torso-receiving tube.

7. The swaddling garment of claim 6, wherein the tubular lower portion comprises an access opening and an envelope fold formed by overlapping inner and outer flaps.

8. The swaddling garment of claim 7, wherein the tubular lower portion is sack-shaped, and comprises a closed bottom end opposite the neck opening.

9. The swaddling garment of claim 8, wherein the first arm-receiving sleeve, the second arm-receiving sleeve, and the torso-receiving tube are configured to apply greater compression than the tubular lower portion.

10. The swaddling garment of claim 6, wherein the tubular lower portion is sack-shaped, and comprises a closed bottom end opposite the neck opening.

11. The swaddling garment of claim 6, wherein the first arm-receiving sleeve, the second arm-receiving sleeve, and the torso-receiving tube are configured to apply greater compression than the tubular lower portion.

12. The swaddling garment of claim 1, wherein the body comprises:

a first leg-receiving tube at a lower end of the torso-receiving tube, the first leg-receiving tube defining a leg-receiving space and having a first leg entry opening; and a second leg-receiving tube at a lower end of the torso-receiving tube, the second leg-receiving tube defining a leg-receiving space and having a second leg entry opening;

wherein the torso-receiving tube has a larger diameter than the first leg-receiving tube and a larger diameter than the second leg-receiving tube.

13. The swaddling garment of claim 12, wherein the torso-receiving tube comprises an access opening and an envelope fold formed by overlapping inner and outer flaps, the access opening disposed above the first and second leg-receiving tubes.

14. The swaddling garment of claim 12, comprising a crotch gusset adjoined to upper ends of the first and second leg-receiving tubes.

15. The swaddling garment of claim 1, wherein the body comprises at least one port opening providing access to the interior volume of the body.

16. The swaddling garment of claim 15, wherein the body is symmetrical about a longitudinal axis, with the first and second arm-receiving sleeves disposed laterally on opposite sides of the longitudinal axis, and the longitudinal axis intersects the at least one port opening.

17. The swaddling garment of claim 15, wherein the body is symmetrical about a longitudinal axis, with the first and second arm-receiving sleeves disposed laterally on opposite sides of the longitudinal axis, and the at least one port opening is offset laterally from the longitudinal axis.

18. The swaddling garment of claim 1, wherein the first and second arm-receiving sleeves are configured to cover the wearer's arms to the wrist and the distal opening of each of the first and second arm-receiving sleeves define a hand opening through which the hands of the wearer's arms can protrude from the first and second arm-receiving sleeves.

19. The swaddling garment of claim 12, wherein the first and second leg-receiving tubes are configured to apply compression to the wearer's legs while allowing movement of the wearer's legs.

* * * * *